United States Patent [19]

Babbitt et al.

[11] 4,232,529

[45] Nov. 11, 1980

[54] ENERGY CONSERVATION REFRIGERATION UNIT

[76] Inventors: Frederick J. Babbitt, 564 Eastern Blvd., Clarksville; Daniel K. Carnine, 1004 Hazelwood, Jeffersonville, both of Ind. 47130

[21] Appl. No.: 929,902

[22] Filed: Aug. 1, 1978

[51] Int. Cl.[3] ..... F25B 13/00; F25B 27/02

[52] U.S. Cl. ..... 62/160; 62/238 R; 62/324 R

[58] Field of Search ..... 62/324 A, 324 D, 238 E, 62/196 B, 199, 160

[56] References Cited

U.S. PATENT DOCUMENTS

| | | | |
|---|---|---|---|
| 3,017,162 | 1/1962 | Haines et al. | 62/196 B X |
| 4,019,338 | 4/1977 | Poteet | 62/238 |

*Primary Examiner*—William E. Wayner

*Attorney, Agent, or Firm*—Edward M. Steutermann

[57] ABSTRACT

The present invention provides an energy conservation and utilization arrangement for use with an expansible refrigerant air conditioner including a refrigerant circuit with a compressor, refrigerant condensor and expansion means to selectively heat a reservoir of fluid, for example, the water used in a swimming pool where selector valve means are provided to selectively supply compressed refrigerant from the air conditioning unit compressor to heat exchange means to transfer heat from the refrigerant to the fluid to be heated, or to the condensor means associated with the air conditioner unit or, when it is desired to heat the fluid but not to provide cooling, to direct compressed refrigerant to the heat exchange means and then to a return conduit, where the return conduit includes refrigerant expansion means to expand the refrigerant means, second heat exchange means to heat the expanded refrigerant and conduit means to return the heated refrigerant to the selector valve means where the selector valve means is adapted to return the refrigerant to compressor means inlet.

5 Claims, 4 Drawing Figures

ENERGY CONSERVATION REFRIGERATION UNIT

BACKGROUND OF THE INVENTION

In recent years, the use of compressed refrigerant air conditioning devices has become commonplace in both commercial and residential applications. In many instances where air conditioning is available, it is also necessary or desirable to have a source of heat for a fluid, for example, water. Such an occasion is found, for example, in residential, apartment, motel or hotel applications where a central air conditioning unit is provided and where there is a swimming pool which is to be heated for a portion of the year. In many instances, there is a coincidence of time periods when it is desirable to provide cooling to the facility served by the air conditioning device and to provide heat to the fluid. For example, in the morning it may be necessary to begin cooling the house or motel rooms and simultaneously heating the water in the swimming pool which has cooled during the night.

However, there are also other situations where air conditioning and selective fluid heating are desirable in industrial applications, for example, where heated water is needed for cleaning or processing purposes.

Heretofore, separate facilities have generally been provided to supply cooling and heating services.

However, with the advent of rapidly escalating energy costs and simultaneous emphasis on energy conservation, the cost of separate facilities necessitates alternate approaches.

SUMMARY OF THE INVENTION

The present invention provides, in general, a fluid circuit for use in association with compressor driven air cooling systems to selectively heat a fluid such as water where the arrangement can be adapted to convert the air conditioning unit for use as a heat pump to efficiently provide heat to the fluid even when the unit is not in use to cool the facility served with cooling.

The present invention provides an inexpensive arrangement to accomplish the aforenoted objectives with a minimum number of elements so that maintenance and opportunity for malfunction is minimal.

Moreover, arrangements within the scope of the present invention substantially reduce energy utilized by elimination of use of duplicate sources of energy and, in most instances, provide an increase in efficiency of the air conditioning unit where it is used to simultaneously provide heating and cooling leading to further effective decrease in energy consumption.

As previously noted, there are many situations where concepts within the scope of the present invention could be utilized, that is, where an air conditioning unit is in use and there is a swimming pool on the premises and within the scope of the present invention, such arrangements can be adapted to take advantage of the present invention.

More particularly, the present invention provides an arrangement to heat a fluid by use of heat from a refrigerant system including a compressor having an inlet and compressed refrigerant outlet communicating with refrigerant condensor means where an outlet of the refrigerant condensor means communicates bypass valve means and thence to expansion means where refrigerant is expanded, cooled and supplied to heat exchanger means and returned to the inlet of the compressor means where in accordance with the present invention first valve means are provided in communication with the compressor outlet to selectively supply compressed refrigerant to the condensor means and to second heat exchange means to transfer heat from the refrigerant to fluid supplied to the second heat exchange means where the refrigerant is then supplied to a heat exchanger outlet conduit communicating with the bypass valve means where the bypass valve means includes bypass valve outlet means communicating with bypass conduit means including second expansion means having an outlet communicating with the outlet from the first condensor means where the bypass valve means is operable from a first position to permit refrigerant flow to the second condensor means and to a second position where the refrigerant flows through the second expansion device to the first condensor outlet where the first valve means is adapted to receive refrigerant from the first condensor where the bypass valve is in second position.

Various other arrangements within the scope of the present invention will become obvious to those skilled in the art upon reading the disclosure set forth hereinafter.

BRIEF DESCRIPTION OF THE DRAWINGS

Referring now to the accompanying drawings which illustrate one arrangement within the scope of the present invention:

Referring now to FIGS. 1A–1C, the illustration of one example of an arrangement in accordance with the present invention shown includes a cooling, for example, an air conditioner, circuit including a compressor 1 having a refrigerant return conduit 10 and a compressed refrigerant outlet 5 communicating with an inlet 6 to a reversing valve 2.

Figure 1B:
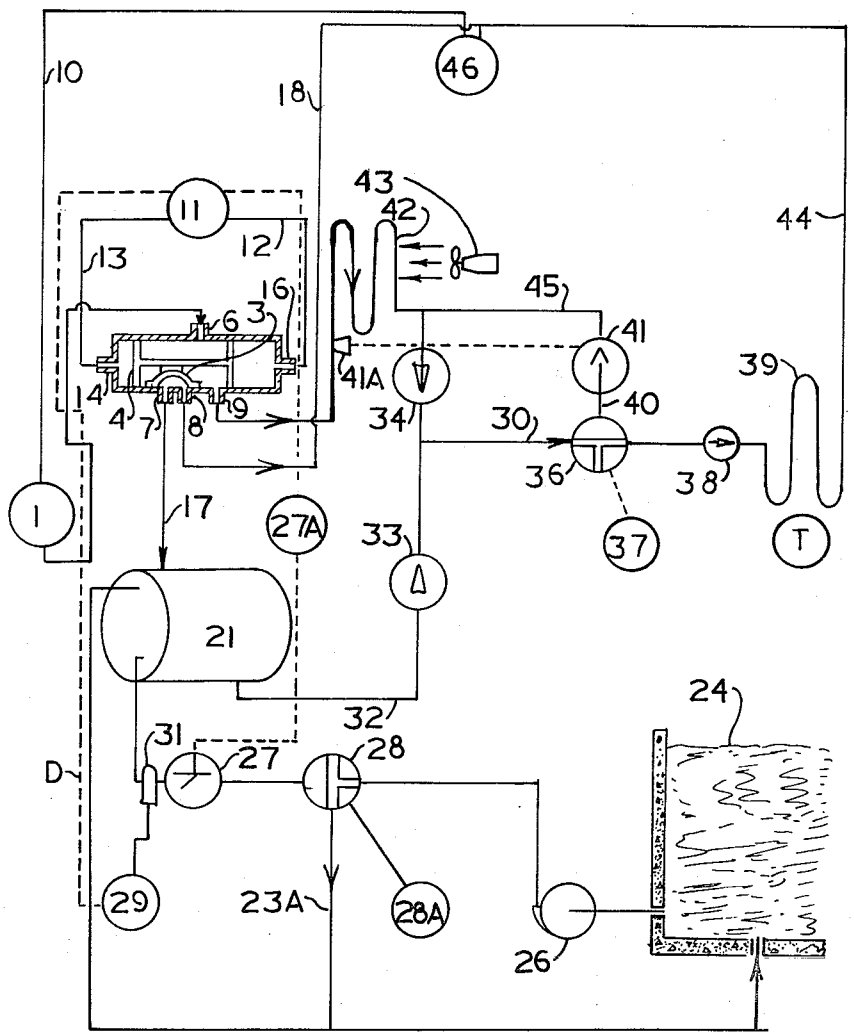
FIGS. 1A–1C are schematic illustrations of three modes of operation of an example of a device within the scope of the present invention.

Reversing valve 2 is, for example, a pneumatic operated slide valve having a two-part valve member 3 operated by pistons 4 adapted for longitudinal movement in valve 2 in response to differential pressure between opposed inlets 14 and 16 provided in valve 2. It will be understood that within the scope of the present invention, while a hydraulic or pneumatic operated valve is shown, any other suitable arrangement, for example, a solenoid valve can be used. Further, it is within the scope of the present invention that multiple valve arrangements can be provided to accomplish the same result. Operation of valve member 3 is provided by a controller 11, which supplied fluid at selected pressure to outlet conduit 13 and 12 communicating with inlets 14 and 16 respectively to position valve member 3 in valve 2 as hereinafter described. Valve 2 is further provided with ports 7, 8, 9 where movement of valve member 3 in valve 2 allows, selective communication between inlet 6 and port 7 and between ports 8 and 9 through valve member 3 where valve body 3 is in the first position shown in FIGS. 1A and 1C. Valve member 3 is selectively moved to a second position shown in FIG. 1B where inlet 6 communicates with port 9 and ports 7 and 8 are in communication through valve member 3.

Figure 1A:
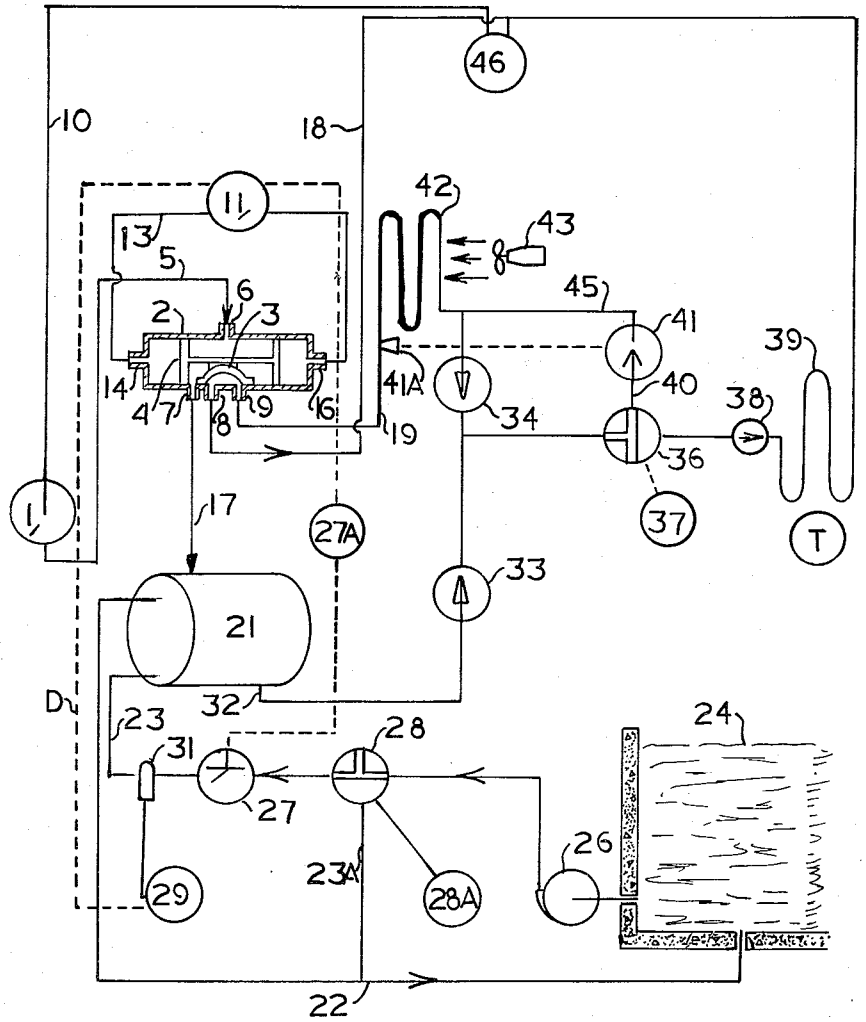
Figure 2:
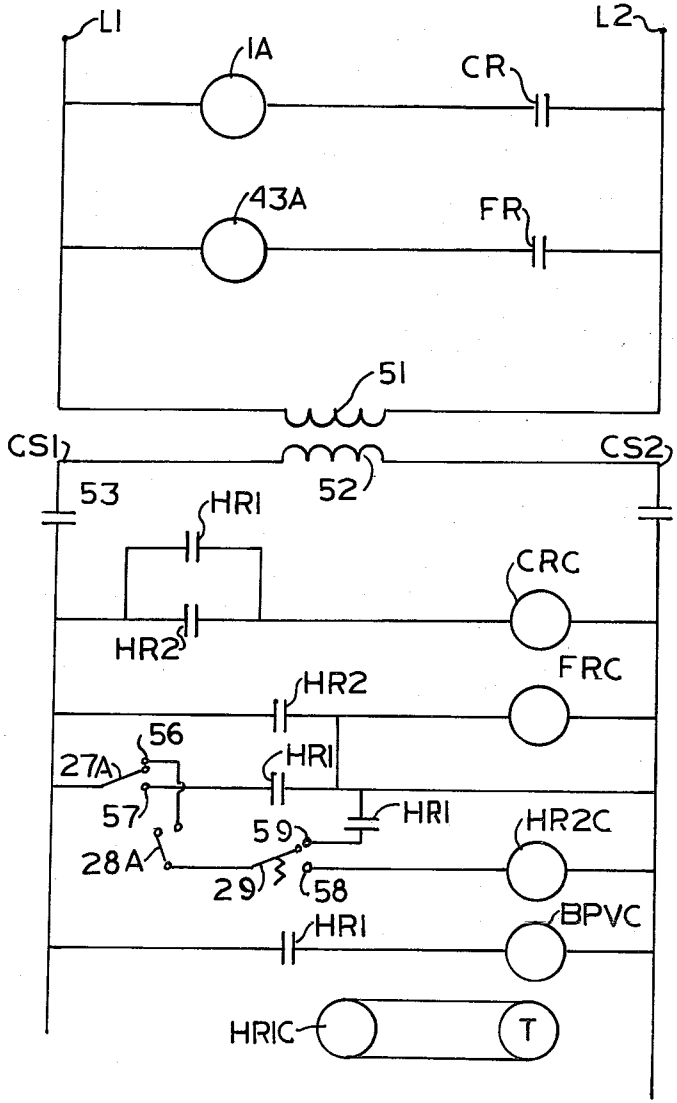
FIG. 2 is a schematic circuit diagram of a control arrangement useful in the arrangement shown in FIG. 1.
Figure 1C:
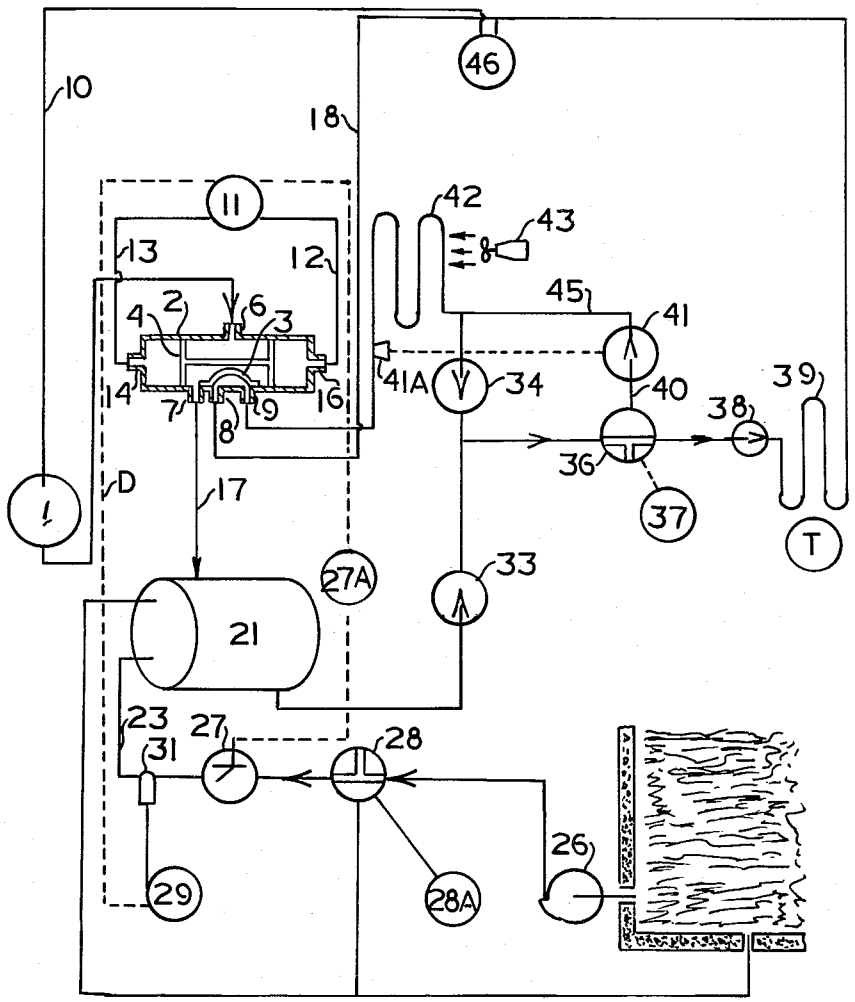

As shown in FIGS. 1A-1C, port 7 communicates by means of a conduit 17 to the shell of a shell and tube heat exchanger 21 where the refrigerant outlet 32 of heat exchanger 21 is supplied to a check valve 33.

Port 8 of valve 2 communicates, by means of a conduit 18, with a refrigerant receiver 46.

Port 9 of valve 2 communicates, by means of a conduit 18, with a condensor 42, which can be disposed in cooperative relation with a condensor fan 43, as is known in the art where condensor 42 communicates with a check valve 34.

As shown, the outlet from check valves 33 and 34 communicate, by means of a conduit 30 with a two-way valve 36 operated by a controller 37 as described hereinafter. Valve 36, as shown in FIG. 1A, has one outlet 40 communicating with a refrigerant expansion valve 41 communicating by means of a conduit 45 with port 9 of valve 2 and in the example shown, conduit 45 communicates with condensor 42 at the end opposite valve 2.

As shown in FIG. 1B, the other outlet of valve 36 communicates with a refrigerant expansion valve 38 located downstream of a heat exchanger 39, for example, the loading means for an air conditioning system located in the space served by the air conditioning system. A return conduit 44 is provided to return warmed refrigerant to receiver 46.

Refrigerant is recycled from receiver to compressor 1 by means of conduit 10.

In accordance with another feature of the present invention, heat exchanger 21 is selectively supplied, on the tube side, with a heat exchange medium, for example, water from a swimming pool 24 by means of a pump 26 communicating with the inlet to heat exchanger 21 by means of a conduit 23. In accordance with one feature of the present invention, a flow detector 27 is provided within conduit 27 to detect flow of water to heat exchanger 21. Also, a temperature sensing element 31 is provided to detect the pool temperature as reflected by the temperature of the water in conduit 23 which is fed back to controller 11 and 37 as described hereinafter. A two-way valve 28 is provided, and operated by controller 29 which senses water pressure to first as shown in FIG. 1A, permit fluid flow to heat exchanger 21 or alternatively as shown in FIG. 1B, to bypass heat exchanger 21 by means of conduit 23A.

The example of the present invention shown in the figures contemplates three modes of operation as follows.

MODE I—FIG. 1A

Mode I as shown in FIG. 1A is arranged to provide heat to the water in pool 24 where no cooling is required in evaporator 39.

Valve 2 is in position where valve member 3 is located so ports 8 and 9 are in communication. In Mode I, the heat compressed refrigerant flows through valve 2 and out port 7 to heat exchanger 21 where it is cooled to heat the water in exchanger 21 and emitted through conduit 32, and check valve 33 to valve 36. In mode I, valve 36 is positioned to direct the refrigerant through expansion valve 41 to condensor 42, which, in mode I acts as an evaporator where expansion valve 41 is operated by a temperature sensing element 41A located in mode I downstream side of condensor 42. It will be recognized that in the example shown, two way valve 36 and valve 2 cooperate to permit the system to operate as a heat pump for heating the water in pool 24.

MODE II—FIG. 1B

FIG. 1B illustrates a second mode of operation within the scope of the present invention where the system operates as a normal air conditioning or refrigerant device where valves 2 and 36 are positioned to utilize condensor 42 as a condensor and provide cooling to evaporator 39. In the arrangement shown, compressed heating refrigerant is supplied to condensor 42, with fan 43 operating then through valve 36 to expansion valve 38 and evaporator 39 to be returned to reservoir 46.

MODE III—FIG. 1C

FIG. 1C is an example of operation of the device where the system is operated to cool evaporator 39 and heat the water in pool 24.

In Mode III operation, the heated compressed refrigerant from compressor 1 is supplied to valve 3. Valve 3 is positioned so the heated refrigerant is supplied to condensor 21 where the refrigerant is compressed. The condensed refrigerant is then supplied to valve 36 which is positioned to permit refrigerant flow to evaporator 39.

In this mode of operation, refrigerant returns to receiver 46 and valve 2 and check valve 34 to isolate condensor 42.

CONTROLS

In the arrangement shown, the position of valve 2 is determined by water flow in conduit 23 as determined by flow detector 27. A flow-no flow signal is transmitted by control conduit from detector 27 to a switch 27A which activates valve controller 11 to the position shown in FIGS. 1A and 1C when there is flow in conduit 23.

Valve 2 can also be activated to the position shown in FIG. 1B even when there is water flow in conduit 23 when the temperature sensed by temperature sensor 31 is above a pre-set maximum where the temperature is transmitted to a switch 29 in a circuit D which controls operation of valve operator 11.

The position of valve 28 is set manually by means of a switch 28A in a circuit D where valve 28 is operable to direct water to heat exchanger 21 or to bypass heat exchanger 21 through bypass 23A. In this regard, switch 28A initiates operation of valve 11 which responds to flow detector 27 where the position of valve 2 is then dependent on the temperature of the water in conduit 23. Pump 26 which is provided for recirculation of water can be the filter pump normally provided with swimming pools.

Valve 36 is operated by a controller 37 in a circuit F from the position shown in FIG. 1A when there is no air conditioning or cooling needed in evaporator 39 to the position shown in FIG. 1B when cooling is needed in evaporator 39 as described hereinafter.

As previously described, the present invention provides several interlocking control arrangements. Referring to FIGS. 1A-1C and FIG. 2, power, for example 240 VDC is supplied by means of terminals 21 and 22. Motor 1A of compressor 1 is wired in parallel between terminals 21 and 22 with a relay CR provided to make the circuit.

Likewise, fan motor 43A is provided in a parallel circuit between terminals 21 and 22 with operation controlled by a relay FR. A step down transformer is provided, for example 240 VDC to 24 VDC having a primary winding in parallel between terminals 21 and 22 and a secondary winding 52 having terminals CS1 and CS2. High compressor pressure cutout relay 53 and low compressor pressure cutout relay 54 are provided in series with secondary winding 52 as shown.

The terminals CS1 and CS2 provide a control power circuit as described hereinafter to control operation of the example of an arrangement in accordance with the present invention as shown in the Figures.

Automatic operation is initiated by a thermostat T located in the space served by evaporator 39 which energizes relay coil HR1C. At a selected temperature in the space served by evaporator 39, coil HR1C is energized by thermostat T so relay HR1 closes a parallel circuit between CS1 and CS2 which includes coil CRC which closes relay CR to initiate compressor operation.

Operation is initially determined by whether there is water flow or not. In this regard, water flow sensing switch 27A is provided (and shown in FIGS. 1A–1C). When there is water, flow switch 27A closes on terminal 51. In this condition, switch 28A is closed to permit water flow through exchanger 21 so operation of the circuit depends on the position of switch 29. When the water in conduit 23 is below the desired temperature, switch 29 closes on terminal 58 which activates coil HR2C to close a relay contacts HR2 which activate valve control 11 to the position shown in FIGS. 1A. When contacts HR2 are open, valve 2 is in the position shown in FIG. 1B.

If the temperature of the water in conduit 23 rises above the desired maximum, switch 29 closes on terminal 59 so that relay coil HR2C is deactivated allowing valve operator 3 to move to the position shown in FIG. 1B even though water continues to flow to heat exchanger 21.

It will be noted that when deactivation of coil HR1C opens, relay contacts HR1 so coil BPVC is also deactivated. Coil BPVC operates valve control 37 which when BPVC is deactivated is in the position shown in FIG. 1A.

In Mode I, operation is achieved, with flow in conduit 23 so switch 27A is closed on terminal 56 with switch 28A closed and switch 29 closed on terminal 58 so HR2C is activated and HR1C is deactivated so contacts HR1 are open.

Various other arrangements within the scope of the present invention will become obvious to those skilled in the art upon reading the foregoing disclosure.

The invention claimed is:

1. A refrigeration system to selectively supply cooling to a space to be cooled and to heat a fluid including:

a. refrigerant compressor means having an expanded refrigerant inlet and a compressed refrigerant outlet;

b. reversing valve means including body means having an inlet communicating with said compressed refrigerant outlet and first, second and third outlet means and valve member means to selectively move from first position to permit communication between said first and second outlets where said valve inlet communicates with said third outlet to second position to permit communication between said second and third outlets where said inlet communicates with said first outlet;

c. reversing valve control means to move said reversing valve member between said first and second positions;

d. first heat exchange means having refrigerant inlet means communicating with said first outlet means of said reversing valve, first exchange fluid inlet means to introduce said fluid to be heated to said first heat exchange means to receive heat from said refrigerant in said first heat exchange means and first exchange fluid outlet means to emit fluid to be heated from said first heat exchanger and first heat exchanger refrigerant outlet means to emit refrigerant from said first heat exchanger;

e. refrigerant heat exchange means having a first fluid flow aperture communicating with said third outlet of said reversing valve means and second fluid flow aperture means;

f. bypass valve means inlcuding valve body means having first refrigerant inlet means communicating with said first heat exchange refrigerant outlet means and said refrigerant heat exchange means, second fluid flow aperture means and first outlet means communicating with said third reversing valve outlet and second outlet means connected to refrigerant evaporator means located in a space to be cooled and valve member means operable from a first position where said bypass valve inlet means communicates with said bypass conduit means to a second position wherein said bypass valve inlet means communicates with said second outlet means;

g. conduit means communicating with the outlet of said evaporator means and said inlet to said compressor means;

h. system control means including first temperature sensing means located in said first exchange fluid inlet means to activate said reversing valve means to said second position at preselected temperature and second temperature sensing means located in said space to be cooled and adpated to move said bypass valve member from said first position to said second position at preselected temperature in said space to be served

2. The invention of claim 1 wherein said bypass valve first outlet means communicates with an inlet to refrigerant expansion means having an outlet communicating with said second fluid flow aperture of said refrigerant heat exchange means.

3. The invention of claim 2 wherein unidirectional flow control means are provided between said second fluid flow aperture of said refrigerant heat exchange means and said inlet to said bypass valve means.

4. The invention of claim 1 wherein unidirectional flow control means are provided between said first heat exchange refrigerant outlet means and said bypass valve means inlet means.

5. The invention of claim 1 including flow detector means located in the first exchange fluid inlet means to operate flow control means to operate said reversing valve from said first position to said second position in response to termination of flow of said first exchange fluid.

* * * * *